US005543598A

United States Patent [19]

Duffour et al.

[11] Patent Number: 5,543,598

[45] Date of Patent: Aug. 6, 1996

[54] SWITCH HAVING A VACUUM INTERRUPTER

[75] Inventors: Henri Duffour, Evian; Philippe Goerend, St. Genis–Pouilly, both of France; Dominique Loutan, Genève, Switzerland

[73] Assignee: Secheron S.A., Geneva, Switzerland

[21] Appl. No.: 295,062

[22] Filed: Aug. 26, 1994

[30] Foreign Application Priority Data

Aug. 27, 1993 [CH] Switzerland ..... 2557/93

[51] Int. Cl.[6] ..... H01H 33/66

[52] U.S. Cl. ..... 218/135; 218/134/138

[58] Field of Search ..... 218/118, 121, 218/134, 135, 139, 155

[56] References Cited

U.S. PATENT DOCUMENTS

| | | | |
|---|---|---|---|
| 3,026,394 | 3/1962 | Jennings | 200/144 |
| 3,539,747 | 11/1970 | Robinson | 200/144 |
| 4,499,349 | 2/1985 | Sakuma et al. | 200/144 B |

FOREIGN PATENT DOCUMENTS

| | | | |
|---|---|---|---|
| 0054670 | 6/1982 | European Pat. Off. | H01H 33/66 |
| 0132804 | 2/1985 | European Pat. Off. | H01H 33/66 |
| 493925 | 8/1970 | Switzerland | H01H 33/66 |
| 2440829 | 3/1976 | United Kingdom | H01H 33/66 |

*Primary Examiner*—Kristine L. Kincaid
*Assistant Examiner*—Michael A. Friedhofer
*Attorney, Agent, or Firm*—Burns, Doane, Swecker & Mathis

[57] ABSTRACT

A switch has a vacuum interrupter and a switch housing which holds the vacuum interrupter between two supply terminals. The vacuum interrupter contains a tubularly constructed, evacuated housing with a fixed contact member and movable contact member. A movable contact carrier of the movable contact member is guided out of the housing in a vacuum-tight manner by a bellows and is held on the housing axis by a slideway. The slideway has a bushing which is detachably mounted on a flange of the housing. The bushing has an axially aligned guide groove situated on an inner surface. A guide element held on the sliding body of the movable contact carrier is guided in this guide groove. The switch prevents undesired axial, radial and torsional acting forces from damaging the bellows, and therefore, ensures the vacuum-tightness of the vacuum interrupter is maintained during manufacturing assembly and operation.

11 Claims, 3 Drawing Sheets

SWITCH HAVING A VACUUM INTERRUPTER

BACKGROUND OF THE INVENTION

1. Field of the Invention

The invention proceeds from a switch having a vacuum interrupter which is arranged between two supply terminals and can be actuated by a drive, and containing a tubularly constructed, evacuated housing with a fixed and a movable contact member, in which the fixed contact member is supported by means of a fixed contact carrier on a first one of the two supply terminals, and a contact carrier, which can be moved by a drive, of the movable contact member is guided out of the housing in a vacuum-tight fashion by means of a bellows and held on the tube axis by means of a slideway and is connected in an electrically conductive fashion to a second one of the two supply terminals.

If such a switch is used as the master switch of an electric traction vehicle, then this switch must execute a comparatively large number of switching operations and is consequently subjected to significant wear. Particularly susceptible to wear in this case is the vacuum interrupter, which is provided in the switch housing and whose vacuum tightness is determined first and foremost by the bellows, which guide the movable contact member outwards out of the tube interior in a vacuum-tight fashion.

2. Discussion of Background

The invention refers to a prior art as in specified, for example, U.S. Pat. No. 4,071,727 A, EP 0 054 670 A2 or EP 0 132 804 B1. A vacuum interrupter described in this prior art has a slideway for a movable contact member which is guided into the tube interior in a vacuum-tight fashion by means of a bellows. In this case, the slideway ensures the guidance of the movable contact member is directed substantially along the tube axis. However, when this vacuum interrupter is fitted into a switch housing, it is not possible reliably to exclude damage to the vacuum interrupter.

SUMMARY OF THE INVENTION

Accordingly, one object of the invention is to provide a novel switch of the type specified at the beginning which can be produced and maintained without difficulty and is distinguished by a high operational reliability even after a large number of switching operations.

The switch according to the invention has a slideway which is easy to produce and which ensures that the guidance of the movable contact member of the vacuum interrupter is aligned strictly axially, and keeps undesired torsional forces and radially acting force components away from the bellows of the vacuum interrupter. This slideway can be mounted very easily on a commercially available vacuum interrupter, with the result that assembling the vacuum interrupter in a housing enclosing this tube is rendered possible without damage being done to the bellows which ensure the vacuum tightness of the vacuum interrupter. At the same time, by axially limiting the contact travel, the slideway prevents compression of the bellows during a switching-off operation. Consequently, the switch can carry out a large number of switching operations without impermissibly loading the bellows mechanically and thus endangering the vacuum tightness of the vacuum interrupter. The switch according to the invention is therefore distinguished by a particularly high operational reliability even after numerous switching operations, as well as by a high degree of ease of assembly and maintenance. It is possible for this reason to use it in a particularly advantageous way as the master switch in electric traction vehicles in which importance is attached to a high degree of reliability under complicated operating conditions even after a long operating time.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein three preferred exemplary embodiments of the invention are represented in a simplified fashion, and specifically.

DESCRIPTION OF THE PREFERRED EMBODIMENTS

Figure 1:
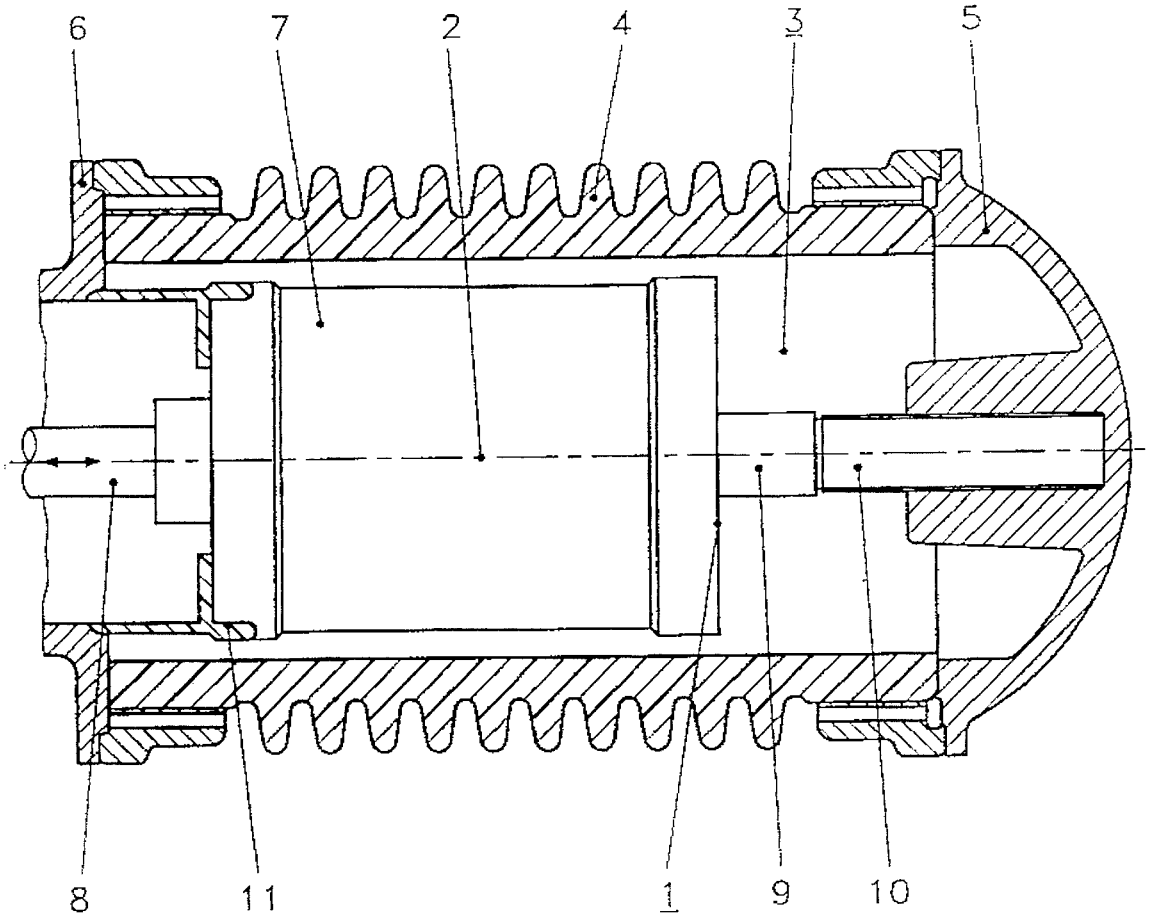
FIG. 1 shows a top view of an axially guided section through a housing, accommodating a vacuum interrupter, of the switch according to the invention.

Referring now to the drawings, wherein like reference numerals designate identical or corresponding parts throughout the several views, in the case of the embodiments of the invention which are represented in FIGS. 1 to 6 a switch which can be mounted on a traction vehicle has an essentially cylindrically symmetrical vacuum interrupter 1. Arranged concentrically with the tube axis 2 is a switch housing 3 which is constructed in a tubular fashion and in which the vacuum interrupter 1 is accommodated. The switch housing 3 consists of a hollow cylindrical isolator 4 and two metallic supply terminals which are rigidly connected to the isolator 4 and of which one is constructed as a cover 5 and the other contains a tubular hollow body 6.

Vacuum interrupters are sold in large numbers by relevant manufacturers and respectively contain a tubular housing 7 (visible in FIG. 1) having two contact members. As is visible in FIG. 1, at the left-hand end of the housing 7 a contact carrier 8, which can be displaced by a drive (marked by a double arrow) in the direction of the tube axis 2, of a movable one of the two contact members is guided in a vacuum-tight fashion through the housing 7 into the interior of the vacuum interrupter 1. The movable contact carrier 8 is connected in an electrically conductive fashion via a connecting element (not represented) to the supply terminal containing the tubular hollow body 6. On the right-hand end of the housing 7, a contact carrier 9 of a fixed one of the two contact members is guided out of the interior of the housing 7 in a vacuum-tight fashion. The fixed contact carrier 9 is constructed as a threaded stub 10 at its end which is guided out. The threaded stub 10 is screwed into a threaded bore (not shown) of the cover 5, which acts as supply terminal, and thus serves, on the one hand, to fix the right-hand end of the vacuum interrupter 1 in the switch housing 3, as well as to form a current path from the fixed contact carrier 9 on to the supply terminal constructed as the cover 5. An insulating part 11 constructed in an essentially annular fashion serves to hold the left-hand end of the vacuum interrupter 1 in the switch housing 3.

One of two contact members is mounted in each case on free ends (not visible) of the contact carriers 8 and 9. During switching on, the movable contact carrier 8 is displaced to the right by the drive, and the two contacts are thereby brought into engagement with one another.

Figure 2:
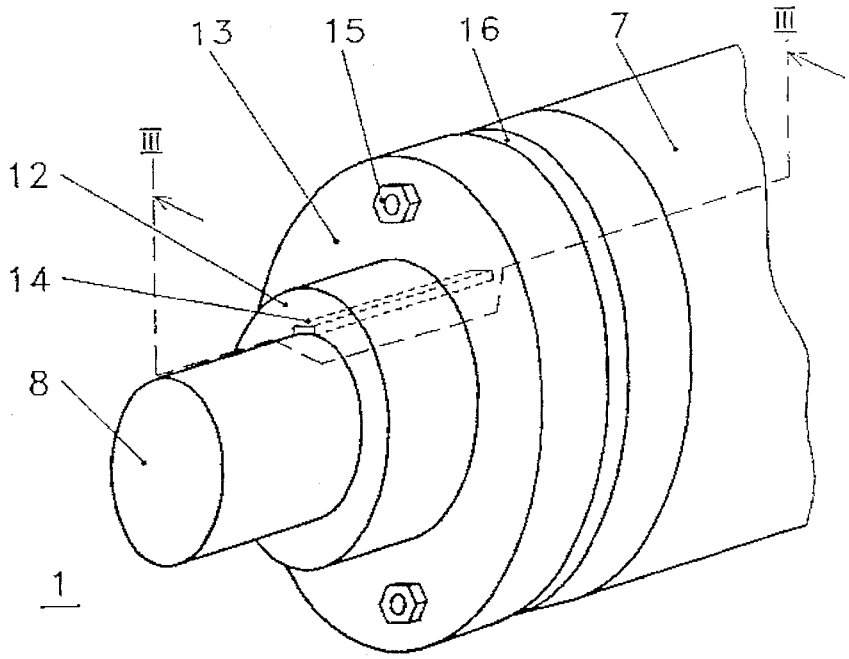
FIG. 2 shows a perspective view of the left-hand end region of the vacuum interrupter of a first embodiment of the switch in accordance with FIG. 1.

Visible in FIG. 2 is a slideway which ensures axial guidance of the contact carrier 8 and by means of which a rotary movement of the movable contact carrier 8 about the tube axis 2 is reliably avoided. This slideway contains a bushing 12 which is of hollow cylindrical design, is made from an abrasion-resistant material, preferably a bearing metal or plastic, such as polytetrafluoroethylene, and has a mounting flange 13 as well as a guide element 14 which is held in a part of the movable contact carrier 8 which acts as a sliding body. The bushing 12 extends in the axial direction at least as far as to ensure that the movable contact carrier 8 is guided axially free from canting. Typically, the axially extending length of the bushing 12 corresponds approximately to the diameter of the sliding body mounted on the inner surface of the bushing 12. The effect of the suitable length of the bushing 12, of mounting the sliding body on the inner surface of the bushing 12 with little play, and of the high flexural strength of the sliding body and of the bushing 12 is that the contact carrier 8 can be displaced only in the axial direction. The mounting flange 13 is mounted on a flange 16 of the housing 7 by means of two screwed joints 15.

Figure 3:
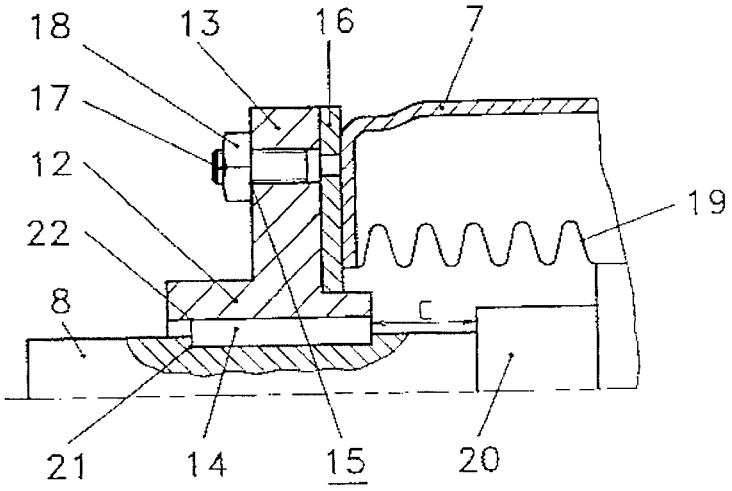
FIG. 3 shows a top view of a section, guided axially along III—III, through the end region of the vacuum interrupter in accordance with FIG. 2.

As is visible in FIG. 3, each of the two screwed joints 15 has a threaded bolt 17, which is mounted on the flange 16 and guided through a bore (not designated) of the mounting flange 13, and a nut 18 which secures the threaded bolt 17, 19 designates a bellows which surrounds the contact carrier 8 and which is connected in a vacuum-tight fashion with its right-hand end to the contact carrier 8 and in a vacuum-tight fashion with its left-hand end to the housing 7. The part of the contact carrier 8 which acts as the sliding body of the slideway ends in a stop 20, which limits the travel c of the movable contact member during switching off. Milled in the part of the contact carrier 8 which serves as the sliding body is a retaining groove 21 which extends in the axial direction and into which a lower section of the guide element 14 is fitted. The guide element 14 is advantageously constructed in a cuboid shape. An upper section of the guide element 14 is guided virtually free from play in a guide groove 22 which is axially aligned and extended on to the inner surface of the bushing 12.

The mode of operation of this embodiment of the AC switch according to the invention is as follows: Upon switching off, the contact carrier 8 of the movable contact member is guided to the left from the switched-on position represented in FIG. 3. The part of the contact carrier 8 which slides on the inner surface of the bushing 12 ensures an exact axial guidance and prevents the transmission of radially active forces from the contact carrier 8 to the bellows, which can occur, in particular, when fitting the vacuum interrupter 1 into the switch housing 3 or during maintenance work. It is ensured at the same time that the drive always acts axially on the moving contact member. Additional guide elements for the drive are therefore dispensible. In addition, the guidance, virtually free from play, of the guide element 14 in the guide groove 22 keeps undesired torsional forces away from the bellows 19. This is of particular advantage in the case of mounting and maintenance work, in which the bellows 19 can otherwise easily be damaged by unintended rotation of the contact carrier 8 and thus the vacuum tightness can be cancelled.

When the movable contact member has traversed a travel c sufficient for producing the insulating clearance of the contacts, the stop 20 strikes against the end of the bushing 12 facing the contacts. Compression of the bellows 19 which is undesirably strong is thus prevented together with premature loss of tightness of the vacuum interrupter 1.

Figure 4:
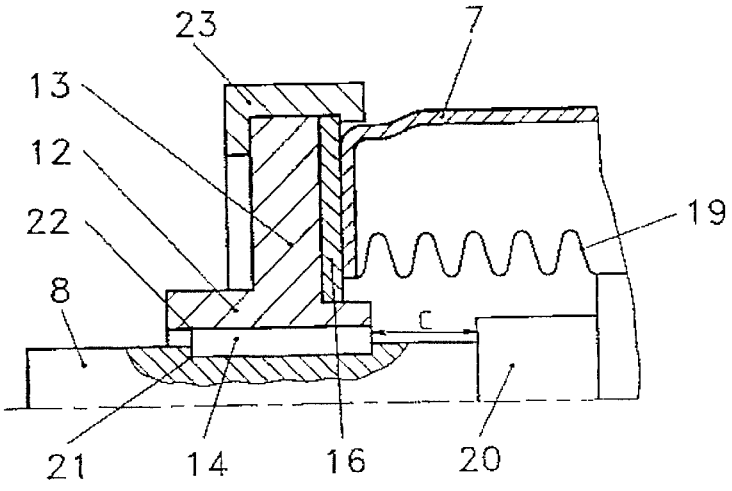
FIG. 4 shows a top view of an axially guided section through the end region of the vacuum interrupter of a second embodiment of the invention slightly modified with respect to the first embodiment.

In the variant of the switch according to the invention represented in FIG. 4, the mounting flange 13 of the bushing 12 is clamped to the flange 16 of the housing 7 by means of a clamping ring 23. As a result, a particularly simple assembly of the bushing 12 is achieved in the case of vacuum interrupters in which the flange 16 of the housing 7 of the vacuum interrupter 1 has no axially guided threaded bolts 17.

Figure 5:
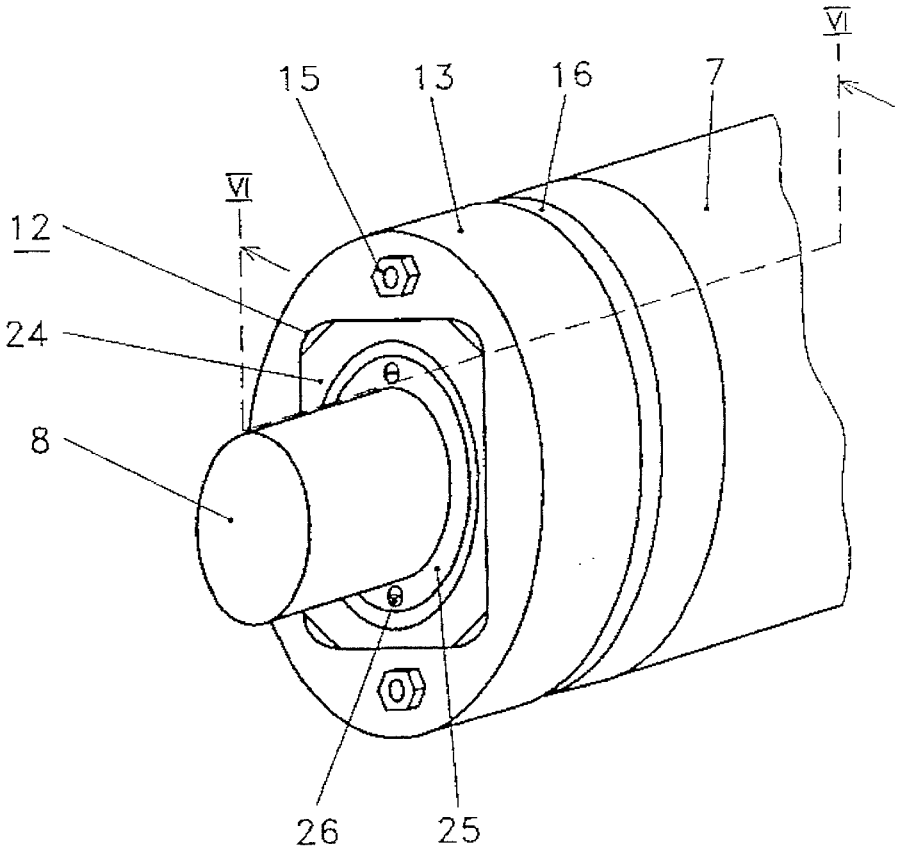
FIG. 5 shows a perspective view of the left-hand end region of the vacuum interrupter of a third embodiment of the switch in accordance with FIG. 1.
Figure 6:
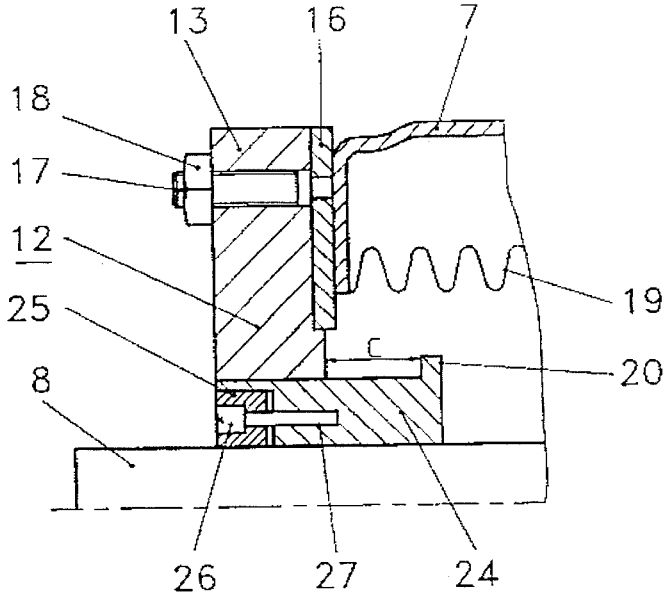
FIG. 6 shows a top view of a section, guided axially along VI—VI, through the end region of the vacuum interrupter of the switch in accordance with FIG. 5.

In the variant of the switch according to the invention represented in FIGS. 5 and 6, the bushing 12 is screwed to the flange 16 according to the variant in accordance with FIGS. 2 and 3, but can also be clamped to the flange 16 according to the variant in accordance with FIG. 4 via a clamping ring 23. The sliding body, guided in the bushing 12, of the movable contact carrier 8 is formed by a sleeve 24 having a profiled lateral surface. The lateral surface advantageously has an eliptical, square, hexagonal or any other polygonal profile. The sleeve 24 is provided with a centrally guided, cylindrical bore. On its end facing the drive, the sleeve 24 has a material cutout which annularly surrounds the movable contact carrier 8 and serves to accommodate a clamping ring 25 which can be pushed on to the movable contact carrier 8. Axially aligned clamping screws 26 are guided through the clamping ring 25. Recessed into the base of the material cutout are axially aligned threaded bores 27 which serve to accommodate the clamping screws 26. The stop 20 is arranged on the sleeve 24 at the end facing the fixed contact member.

The bushing 12 has an inner surface which is matched to the lateral surface of the sleeve 24. Bushing 12 and/or sleeve 24 are formed from abrasion-resistant material, preferably bearing metal and/or a plastic such as, in particular, polytetrafluoroethylene.

During assembly, the sleeve 24 is pushed on to a cylindrical part of the movable contact carrier 8 which fits into the bore, and fixed on the contact carrier by screwing the clamping ring 25. Since the bushing 12 has an inner surface matched to the lateral surface of the sleeve 24, in this variant of the invention as well a strictly axially aligned guidance of the movable contact carrier is always ensured and radially and/or azimuthally directed movements of the movable contact carrier 8 are completely avoided in accordance with the previously described exemplary embodiments. By suitably fixing the sleeve 24, it is achieved during switching off that after traversing the prescribed travel c of the movable contact member the stop 20 strikes against the end of the bushing 12 facing the fixed contact member, and that excessive compression of the bellows 19 is thereby avoided.

This embodiment of the invention is particularly suitable for vacuum interrupters which have a movable contact member with a smooth, cylindrical contact carrier 8, whereas the embodiments in accordance with FIGS. 2 and 3 and in accordance with FIG. 4 are particularly suitable for vacuum interrupters in which a groove-shaped depression is already provided in the contact carrier of the movable contact member.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A switch comprising:

a vacuum interrupter arranged between two supply terminals and actuatable by a drive, a tubularly constructed, evacuated housing with a fixed contact member and a movable contact member, the fixed contact member is supported by a fixed contact carrier on a first one of the two supply terminals, and the movable contact member has a movable contact carrier guided out of the housing in a vacuum-tight fashion by a bellows and is held on a housing axis by a slideway, the movable contact carrier is electrically connected to a second one of the two supply terminals, wherein the slideway has a bushing which is detachably mounted on a flange of the housing, and an axially aligned guide groove provided in an inner surface of the bushing and a sliding body of the movable contact carrier has a guide element which is guided in the guide groove and held on the movable contact carrier.

2. The switch as claimed in claim 1, wherein the bushing has a mounting flange mounted on the housing flange by threaded bolts or by a clamping ring.

3. The switch as claimed in claim 1, wherein the sliding body of the movable contact carrier has a stop which cooperates with the bushing and limits the travel of the movable contact member during switching off.

4. The switch as claimed in claim 1, wherein a retaining groove partially accommodating the guide element is provided in a part of the movable contact carrier which serves as the sliding body.

5. The switch as claimed in claim 4, wherein a part of the guide element averted from the retaining groove is guided substantially free from play in the guide groove.

6. A switch comprising:

a vacuum interrupter arranged between two supply terminals and actuatable by a drive;

a tubularly constructed, evacuated housing with a fixed contact member and a movable contact member, the fixed contact member being supported by a fixed contact carrier on a first one of the two supply terminals, the movable contact member having a movable contact carrier guided out of the housing in a vacuum-tight fashion by a bellows and being held on a housing axis by a slideway, the movable contact carrier being electrically connected to a second one of the two supply terminals;

wherein the slideway has a bushing which is detachably mounted on a flange of the housing, the bushing has an inner surface deviating from a surface of revolution and the movable contact carrier has a sliding body having a lateral surface matched to the inner surface of the bushing which deviates from a surface of revolution.

7. The switch as claimed in claim 6, wherein the sliding body is formed by a sleeve disposed on a cylindrical part of the movable contact carrier, the sleeve having the lateral surface.

8. The switch as claimed in claim 7, wherein the lateral surface has an eliptical, square, hexagonal or any other polygonal profile.

9. The switch as claimed in claim 7, wherein an end of the sleeve facing the fixed contact member has a stop which limits the travel of the movable contact member during switching off.

10. The switch as claimed in claim 7, wherein at its end averted from the movable contact member the sleeve has a material cutout which annualarly surrounds the movable contact carrier and serves to accommodate a clamping ring pushed on to the movable contact carrier.

11. The switch as claimed in claim 10, wherein axially aligned clamping screws are guided through the clamping ring, and there are provided in the base of the material cutout axially aligned threaded bores which serve to accommodate the clamping screws.

* * * * *